US007541554B2

(12) United States Patent
Hou

(10) Patent No.: US 7,541,554 B2
(45) Date of Patent: Jun. 2, 2009

(54) KEY STRUCTURE

(75) Inventor: Wen-Kuang Hou, Miaoli County (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 11/859,245

(22) Filed: Sep. 21, 2007

(65) Prior Publication Data

US 2008/0075516 A1 Mar. 27, 2008

(30) Foreign Application Priority Data

Sep. 26, 2006 (TW) ..... 95217155 U

(51) Int. Cl.
*H01H 13/70* (2006.01)

(52) U.S. Cl. ..... 200/517; 200/344; 200/345

(58) Field of Classification Search ..... 200/5 A, 200/5 R, 6 A, 517, 333, 341–345, 1 B; 400/490–496
See application file for complete search history.

(56) References Cited

U.S. PATENT DOCUMENTS

| | | | | |
|---|---|---|---|---|
| 6,246,019 | B1 * | 6/2001 | Nakamura et al. | 200/6 A |
| 6,567,074 | B2 * | 5/2003 | Numata et al. | 345/169 |
| 6,586,689 | B2 * | 7/2003 | Kuriyama | 200/6 A |
| 6,750,406 | B2 * | 6/2004 | Komatsu et al. | 200/1 B |
| 6,914,202 | B2 * | 7/2005 | Sugimoto et al. | 200/1 B |
| 7,288,732 | B2 * | 10/2007 | Hashida | 200/5 A |
| 7,312,410 | B2 * | 12/2007 | Griffin et al. | 200/5 A |

* cited by examiner

*Primary Examiner*—Michael A Friedhofer
(74) *Attorney, Agent, or Firm*—Quintero Law Office

(57) ABSTRACT

A key structure comprises a membrane circuit, a substrate, a cover and a press element. The membrane circuit comprises at least one first signal generator and a second signal generator. The substrate is disposed below the membrane circuit to support the membrane circuit. The cover comprises a body and at least one protrusion, wherein the protrusion is disposed on the body corresponding to the first signal generator. The press element is disposed on the second signal generator, wherein when force is applied on the cover, the protrusion presses the first signal generator.

12 Claims, 6 Drawing Sheets

KEY STRUCTURE

BACKGROUND OF THE INVENTION

1. Field of the Invention

The invention relates to a key structure, and more particularly to a key structure of a thin keyboard.

2. Description of the Related Art

Longitudinal key (for example, space key) of a conventional thin keyboard comprises a signal generator located in a center region thereof. When force is applied on a center region of the longitudinal key, a signal generator is pressed to generate an electronic signal.

However, contact distance of a thin keyboard is minimal. Thus, when force is applied on the side region of the longitudinal key, the longitudinal key curves, and the signal generator located in the center region is not actuated, which decreases user's work efficiency.

BRIEF SUMMARY OF THE INVENTION

A key structure comprises a membrane circuit, a substrate, a cover and a press element. The membrane circuit comprises at least one first signal generator and a second signal generator. The substrate is disposed below the membrane circuit to support the membrane circuit. The cover comprises a body and at least one protrusion, wherein the protrusion is disposed on the body corresponding to the first signal generator. The press element is disposed on the second signal generator, wherein when a force is applied on the cover, the protrusion presses the first signal generator.

When utilizing the key structure of the invention, it does not matter where on the cover force is applied (e.g. center or side region), the signal generator will be effectively actuated, thus, increasing user's work efficiency and convenience.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
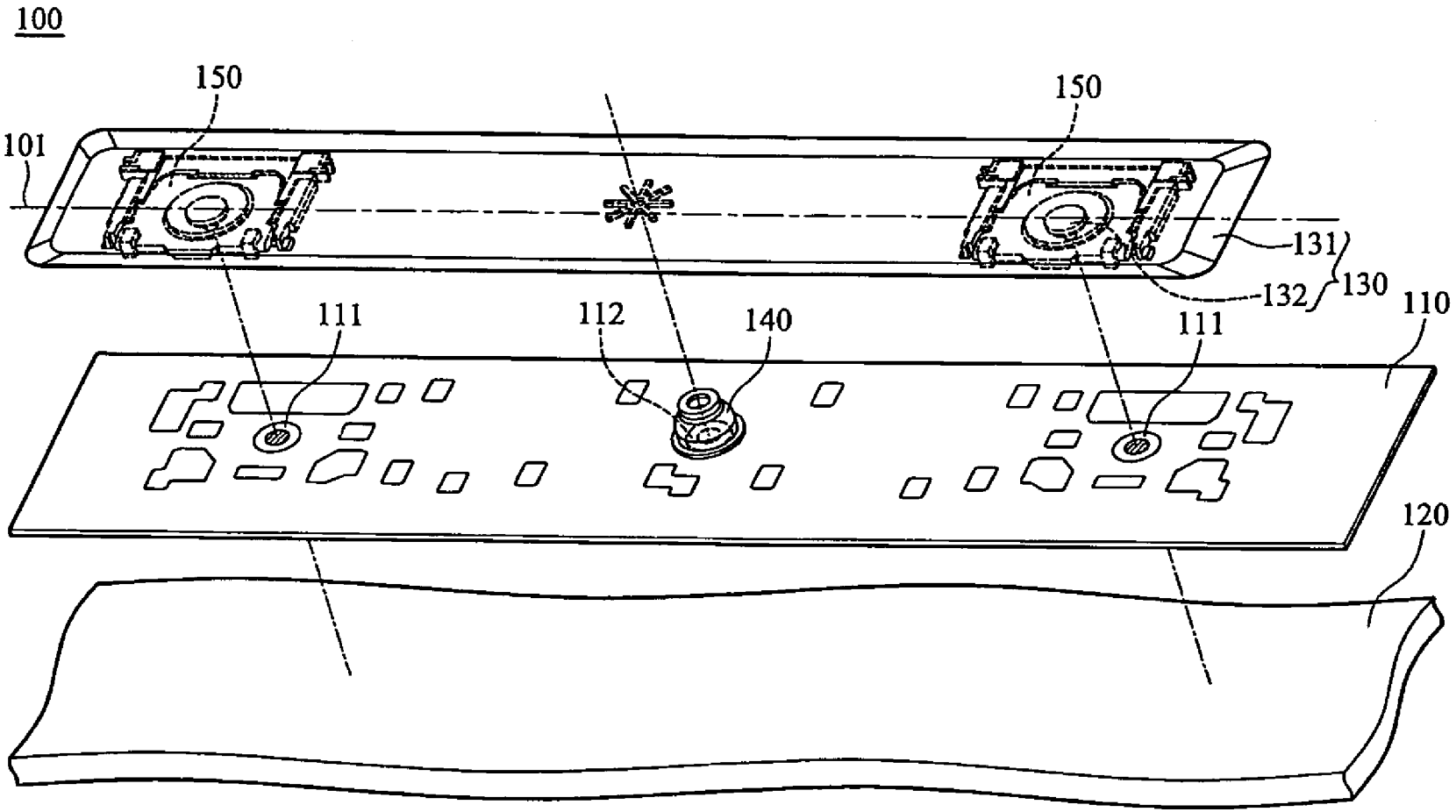
FIG. 1 shows an embodiment of a key structure according to the invention.

FIG. 1 shows an embodiment of a key structure 100 according to the invention, comprising a membrane circuit 110, a substrate 120, a cover 130, a press element 140 and elastic mechanisms 150. The membrane circuit 110 comprises a plurality of first signal generators 111 and a second signal generator 112. The substrate 120 is disposed below the membrane circuit 110 to support the membrane circuit 110. The cover 130 comprises a body 131, a plurality of protrusions 132 and a major axis 101. The protrusions 132 are located on the major axis 101 and disposed on the body 131 corresponding to the first signal generators 111. The press element 140 is disposed on the second signal generator 112 corresponding to the center of the cover 130. When the key structure 100 is assembled, the press element 140 is located between the protrusions 132, and the elastic mechanisms 150 are disposed between the cover 130 and the substrate 120.

Figure 2A:
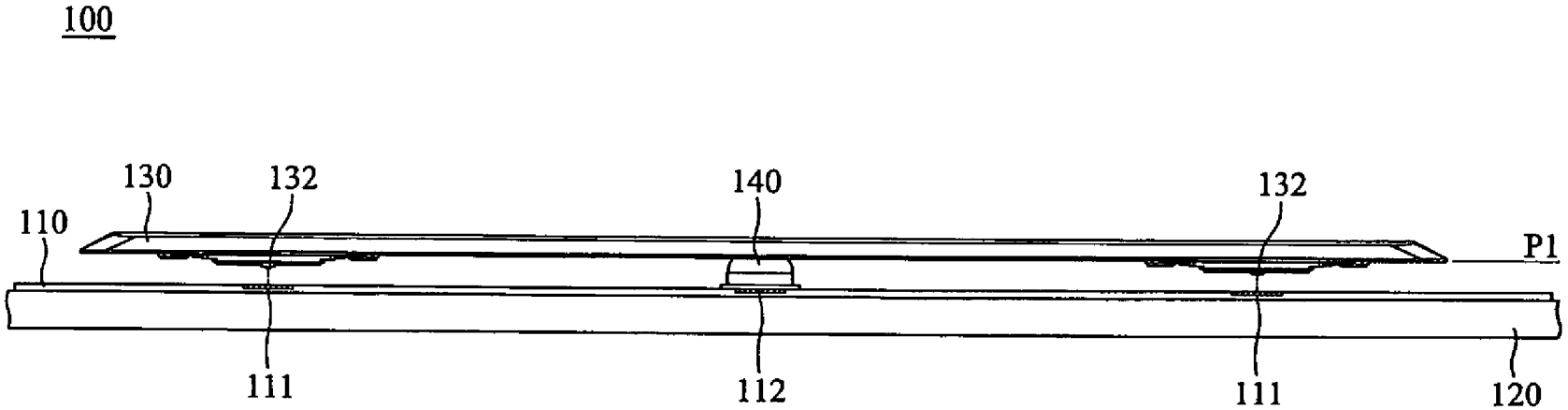
FIG. 2*a* shows a cover of a key structure in a first position according to the invention.
Figure 2B:
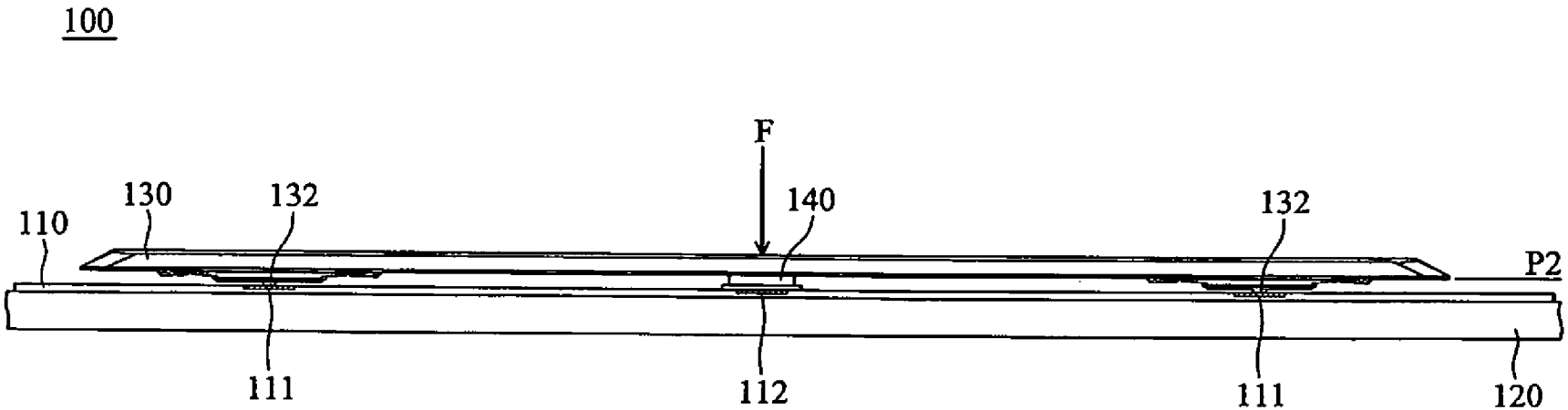
FIG. 2*b* shows the cover of a key structure in a second position according to the invention.

As shown in FIG. 2*a*, the cover 130 is in a first position (un-pressed position) P1 without force applied thereon. With reference to FIG. 2*b*, when a force F is applied on the center of the cover 130, the cover 130 is moved to a second position P2, wherein the protrusions 132 press the first signal generators 111, and the press element 140 presses the second signal generator 112 to generate an electric signal.

Figure 3:
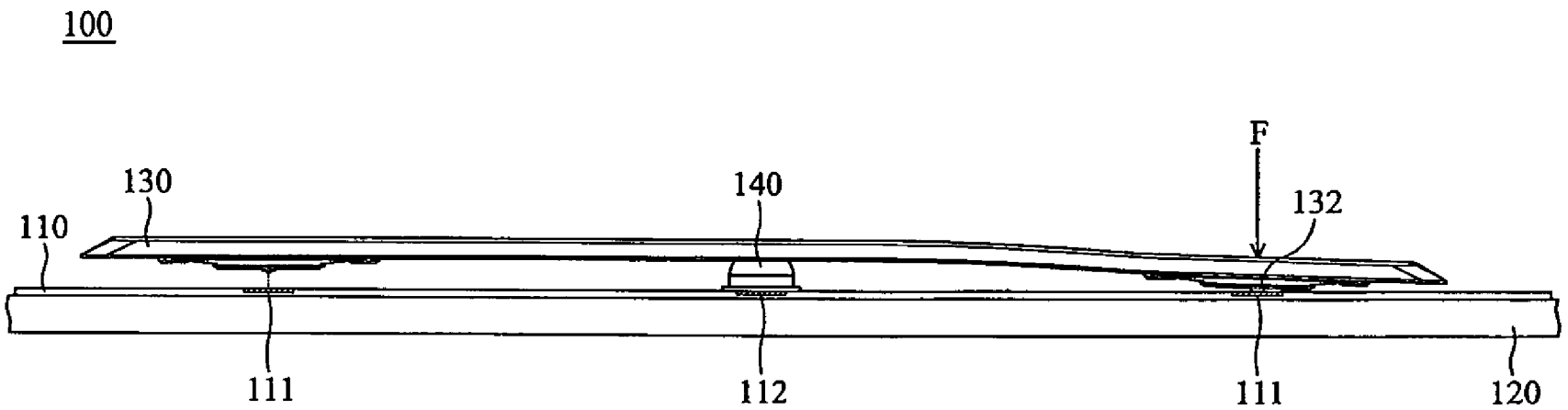
FIG. 3 shows force applied on a side region of the cover of a key structure according to the invention.

With reference to FIG. 3, when force F is applied on a side region of the cover 130, the protrusion 132 presses the first signal generator 111 to generate electronic signal even though the press element 140 does not press the second signal generator 112. It does not matter where on the cover 130 force F is applied (e.g. center or side region), the signal generator will be effectively actuated thus, increasing user's work efficiency and convenience.

The elastic mechanisms 150 are scissors-type structures providing a recovery force moving the cover from the second position to the first position. The elastic mechanisms 150 are disposed above the first signal generators 111 passing the membrane circuit 1110 abutting the substrate 120 and the cover 130. In the Figures of the embodiment, the movement of the elastic mechanisms 150 are omitted to show the protrusions contacting the first signal generators more clearly.

In the embodiment, the press element is a dome rubber element. The protrusions are also rubber elements. However, the invention is not limited thereto. The press element and protrusions can be made with other materials or in other shapes.

Figure 4:
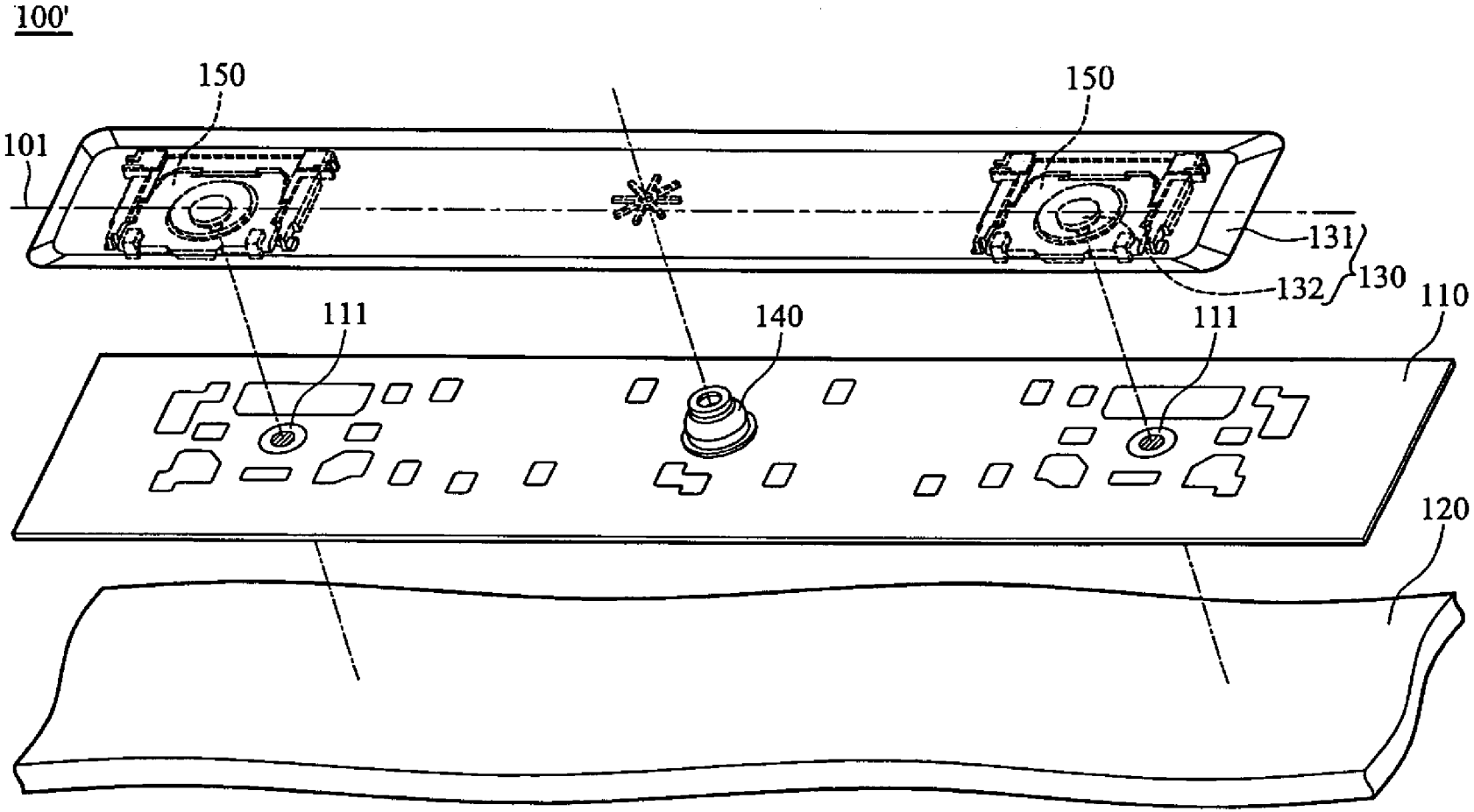
FIG. 4 shows a modified embodiment of a key structure according to the invention.

FIG. 4 shows a modified embodiment of a key structure 100' according to the invention, wherein the second signal generator 112 is omitted, and the electric signal is generated by the first signal generators 111. In the embodiment of FIG. 4, the press element 140 provides a click feeling.

Figure 5:
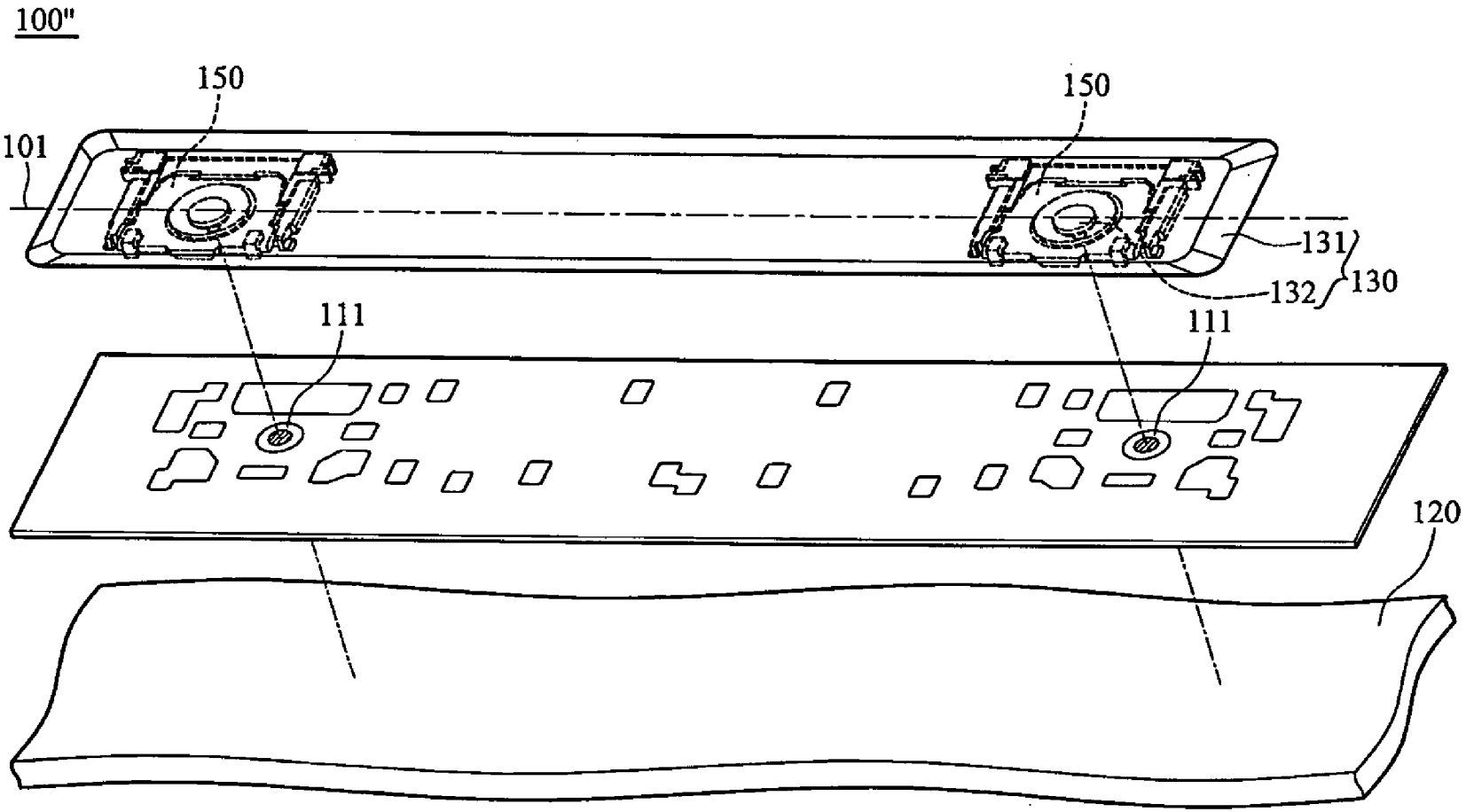
FIG. 5 shows another modified embodiment of a key structure according to the invention.

FIG. 5 shows another modified embodiment of a key structure 100" according to the invention, wherein the second signal generator 112 and the press element 140 are omitted, and the electric signal is generated by the first signal generators 111.

In the embodiments, the elastic mechanisms 150 are disposed above the first signal generators. However, the invention is not limited thereto. The elastic mechanisms 150 can be disposed in other positions between the cover 130 and the substrate 120.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A key structure of a computer keyboard, comprising:

a membrane circuit, comprising at least one first signal generator and a second signal generator;

a substrate, disposed below the membrane circuit to support the membrane circuit;

a keycap, comprising a body and at least one protrusion, wherein the protrusion is disposed on the body corresponding to the first signal generator; and a press element, disposed on the membrane circuit corresponding to the second signal generator, wherein when a force is applied on the keycap corresponding to the first signal generator, the protrusion presses the first signal generator to generate an input signal, and when the force is applied on the keycap corresponding to the second signal generator, the press element presses the second signal generator to generate the same input signal.

2. The key structure as claimed in claim 1, further comprising an elastic mechanism, disposed between the keycap and the substrate, wherein the elastic mechanism provides a recover force pushing the keycap to an un-pressed position.

3. The key structure as claimed in claim 2, wherein the elastic mechanism is located above the first signal generator.

4. The key structure as claimed in claim 2, wherein the elastic mechanism is a scissors-type structure.

5. The key structure as claimed in claim 1, wherein press element is made of rubber.

6. The key structure as claimed in claim 1, wherein the protrusion is made of rubber.

7. A key structure of a computer keyboard, comprising:

a membrane circuit, comprising two first signal generators and a second signal generator;

a substrate, disposed below the membrane circuit to support the membrane circuit;

a keycap, comprising a body and two protrusions, wherein the protrusions are disposed on the body corresponding to the first signal generators; and a press element, disposed on the membrane circuit corresponding to the second signal generator, wherein when a force is applied on the keycap corresponding to one of the first signal generators, one of the protrusions presses press one of the first signal generators to generate an input signal, and when the force is applied on the keycap corresponding to the second signal generator, the press element presses the second signal generator to generate the same input signal.

8. The key structure as claimed in claim 7, wherein the press element corresponds to a center of the keycap.

9. The key structure as claimed in claim 8, wherein the press element is located between the protrusions.

10. The key structure as claimed in claim 8, wherein the keycap comprises a major axis, and the protrusions are located on the major axis.

11. A key structure of a computer keyboard, comprising:

a membrane circuit, comprising at least one first signal generator;

a substrate, disposed below the membrane circuit to support the membrane circuit;

a keycap, comprising a body and at least one protrusion, wherein the protrusion is disposed on the body corresponding to the first signal generator, and when a force is applied on the keycap, the protrusion presses the first signal generator; and an elastic mechanism disposed between the keycap and the substrate, wherein the elastic mechanism is a scissors-type structure, and provides a recover force pushing the keycap to an un-pressed position.

12. The key structure as claimed in claim 11, wherein the elastic mechanism is located above the first signal generator.

* * * * *